US007273208B2

(12) United States Patent
Moffat et al.

(10) Patent No.: US 7,273,208 B2
(45) Date of Patent: Sep. 25, 2007

(54) BALLISTIC AEROSOL MARKING VENTURI PIPE GEOMETRY FOR PRINTING ONTO A TRANSFUSE SUBSTRATE

(75) Inventors: Karen Ann Moffat, Brantford (CA); Subajinie Sathiyavanthan, Etobicoke (CA); Maria N. V. McDougall, Burlington (CA); Edward G. Zwartz, Mississauga (CA); Richard P. N. Veregin, Mississauga (CA); Caroline Melanie Turek, Hamilton (CA)

(73) Assignee: Xerox Corporation, Stamford, CT (US)

( * ) Notice: Subject to any disclaimer, the term of this patent is extended or adjusted under 35 U.S.C. 154(b) by 245 days.

(21) Appl. No.: 11/224,848

(22) Filed: Sep. 13, 2005

(65) Prior Publication Data

US 2007/0057387 A1 Mar. 15, 2007

(51) Int. Cl.
*B01F 3/04* (2006.01)
*B41J 2/015* (2006.01)
*B41J 2/135* (2006.01)

(52) U.S. Cl. ..... 261/76; 261/116; 347/21; 347/83

(58) Field of Classification Search ..... 261/76, 261/116; 347/20, 21, 45, 73, 83
See application file for complete search history.

(56) References Cited

U.S. PATENT DOCUMENTS 6,116,718 A 9/2000 Peeters et al.
6,290,342 B1 9/2001 Vo et al.
6,293,659 B1 9/2001 Floyd et al.
6,302,513 B1 * 10/2001 Moffat et al. ..... 347/20
6,309,042 B1 * 10/2001 Veregin et al. ..... 347/21
6,328,409 B1 12/2001 Peeters et al.
6,328,436 B1 12/2001 Floyd et al.
6,340,216 B1 1/2002 Peeters et al.
6,353,723 B1 3/2002 Hays et al.
6,365,318 B1 * 4/2002 Moffat et al. ..... 430/137.15
6,383,561 B1 * 5/2002 Moffat et al. ..... 427/180
6,387,442 B1 * 5/2002 Moffat et al. ..... 427/180
6,416,157 B1 7/2002 Peeters et al.
6,416,158 B1 7/2002 Floyd et al.
6,416,159 B1 7/2002 Floyd et al.
6,439,711 B1 * 8/2002 Carlini et al. ..... 347/100
6,454,384 B1 9/2002 Peeters et al.
6,467,862 B1 10/2002 Peeters et al.
6,467,871 B1 10/2002 Moffat et al.
6,511,149 B1 1/2003 Peeters et al.
6,521,297 B2 2/2003 McDougall et al.
6,523,928 B2 2/2003 Peeters et al.
6,598,954 B1 7/2003 Moffat et al.
6,673,501 B1 * 1/2004 Combes et al. ..... 430/108.22
6,719,399 B2 4/2004 Moffat et al.
6,751,865 B1 6/2004 Peeters et al.
2001/0045971 A1 * 11/2001 Moffat et al. ..... 347/20
2002/0012752 A1 * 1/2002 McDougall et al. ..... 427/421
2003/0175609 A1 * 9/2003 Combes et al. ..... 430/108.22

* cited by examiner

*Primary Examiner*—Scott Bushey
(74) *Attorney, Agent, or Firm*—Fay Sharpe LLP; Eugene O. Palazzo

(57) ABSTRACT

Various venturi configurations are described that are particularly significant for ballistic aerosol marking (BAM) applications. The specific venturi geometries enable the printing of lines having sharp edges and particular widths, using relatively low pressures.

27 Claims, 7 Drawing Sheets

BALLISTIC AEROSOL MARKING VENTURI PIPE GEOMETRY FOR PRINTING ONTO A TRANSFUSE SUBSTRATE

BACKGROUND

Powder Ballistic Aerosol Marking (BAM) technology is a direct marking process, which is targeted to deliver solid toner particles on demand to a substrate, using an array of venturi structured pipes. Printing channels containing a venturi structure can provide a much collimated, high velocity gas stream to carry the printing material to the substrate. Currently, venturi structured BAM channels can be fabricated at 300 dpi resolution or higher (600 to 900 dpi) out of a polymeric photoresist material. The inner diameter of the channels typically ranges from 40 to 60 μm. In addition, high velocity gas jets enabled by the venturi convergence/divergence structure enable the gas stream of toner particles that exit the expansion pipes to remain collimated (in a narrow stream) well beyond the exit point of the pipes.

The original BAM concept was based on using high input air pressure of 100 psi or higher as the propellant to generate high velocity particles traveling at more than 200 m/sec. The kinetic energy of the particles is converted into thermal energy upon impact with the substrate and causes subsequent fusing of the particles directly onto the substrate. Kinetic fusing has been demonstrated for toner particles directly impacting a glass plate to produce a 3-dimensional pixel of piled toner. When extended to a plain paper substrate, toner capture by paper is typically very poor. As a consequence, in practice, toner is ejected onto an intermediate transfuse belt substrate, which captures all the ejected toner which is then subsequently transfused off-line.

A polymeric photoresist material for forming venturi structured channels is the preferred material over silicone not only due to material costs and ease of fabrication, but also because low cohesive BAM toners do not adhere to the walls of the channels as observed for silicone BAM channels. Although satisfactory in many respects, current BAM venturi configurations are in need of further development. Accordingly, there is a need for an improved venturi configuration particularly adapted for BAM applications.

INCORPORATION BY REFERENCE

U.S. Pat. Nos. 6,116,718; 6,293,659; 6,328,409; 6,340,216; 6,416,157; 6,511,149; 6,598,954; and 6,719,399 are all herein incorporated by reference.

BRIEF DESCRIPTION

In a first aspect, the exemplary embodiment provides a ballistic aerosol marking venturi. The venturi defines a channel width, an inlet, an outlet opposite from the inlet, a venturi throat between the inlet and the outlet, a divergence location between the venturi throat and the outlet, and a particle inlet location between the divergence location and the outlet. The ratio of the channel width to the width of the venturi throat ranges from about 7:1 to about 2:1, respectively.

In another aspect, the exemplary embodiment provides a ballistic aerosol marking venturi. The venturi defines a channel width, an inlet, an outlet opposite from the inlet, a venturi throat between the inlet and the outlet, a divergence location between the venturi throat and the outlet, a channel length extending between the venturi throat and the outlet, and a particle inlet location between the divergence location and the outlet. The ratio of the channel length to the channel width ranges from about 125:1 to about 14:1, respectively.

In a further aspect, the exemplary embodiment provides a ballistic aerosol marking system including a venturi and a particle source. The venturi defines a channel width, an inlet, an outlet opposite from the inlet, a venturi throat between the inlet and the outlet, a divergence location between the venturi throat and the outlet, a channel length extending between the venturi throat and the outlet, and a particle inlet location between the divergence location and the outlet. The particle source is in communication with the inlet. The ratio of the channel width to the average size of particles of the particle source is in the range of from about 700:1 to about 2:1, respectively.

DETAILED DESCRIPTION

In accordance with the exemplary embodiment, particular BAM channels with certain venturi configurations were identified. Specifically, venturi throat width, channel length, venturi divergence length and location of the toner aperture were analyzed. Through a systematic evaluation of different pipe geometries by quantifying a printed line width and scatter of the toner on a transfuse belt substrate, two exemplary embodiment channel geometries were identified.

Figure 1:
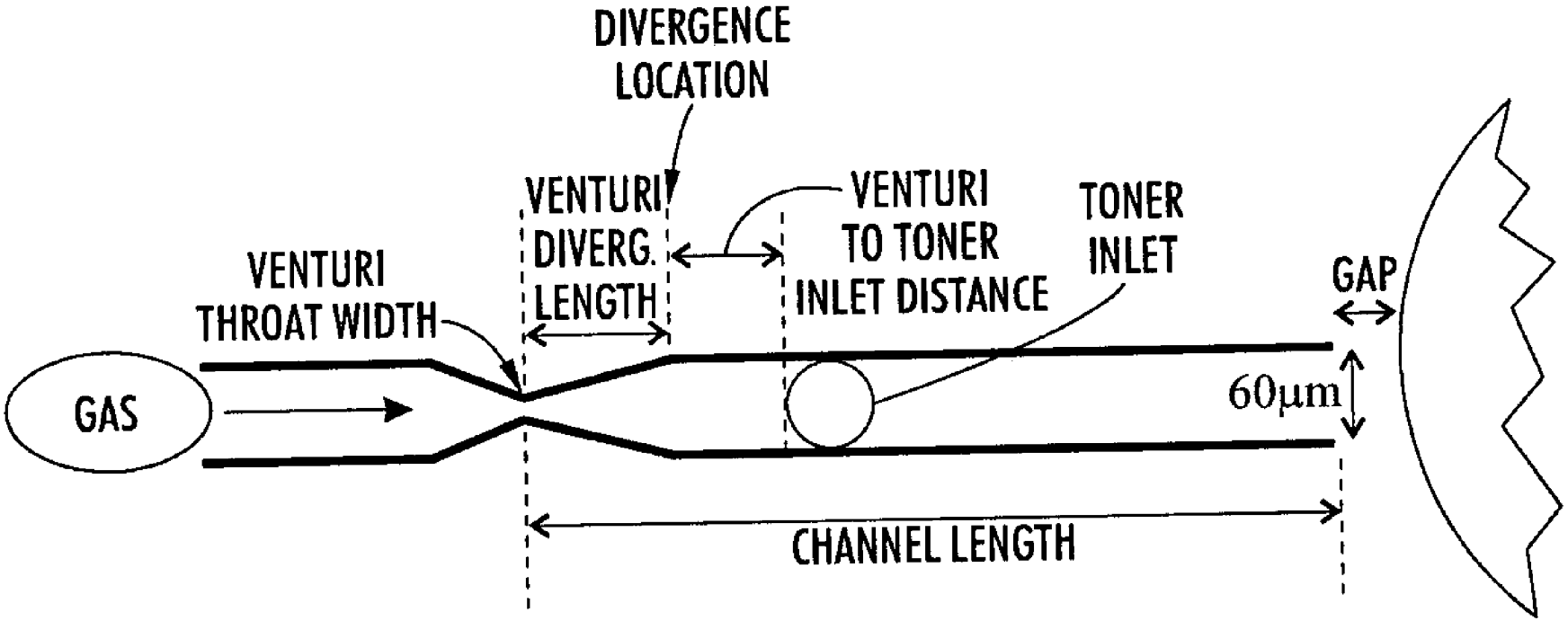
FIG. 1 is a schematic cross-sectional view of an exemplary embodiment ballistic aerosol marking venturi pipe geometry.

The exemplary embodiments provide specific and unique BAM pipe geometries that enable continuous BAM printing without gating toner directly onto an intermediate transfuse belt substrate. A cross-section of the BAM venturi channel is generally as depicted in FIG. 1. Referring to FIG. 1, the various venturi configurations described herein utilize particular dimensions, proportions, or combinations of dimensions and proportions, for certain aspects of the venturi. The venturi pipes include a gas inlet depicted on the left hand side of the venturi schematic shown in FIG. 1. Gas, under pressure enters the venturi at this inlet. The venturi defines a narrowed or constricted region, referred to herein as the "venturi throat." The diameter or span of the opening at that location is the "venturi throat width." As the gas passes through that region and exits the throat, the interior diameter or span opening increases until the diameter reaches some maximum value, or generally, returns to the original diameter or span of the venturi pipe. The distance between the venturi throat and the location within the venturi channel at which the venturi diameter returns to its maximum or original diameter, referred to herein as the "divergence location," is referred to herein as the "venturi divergence length." At a location between the divergence location and the end of the venturi pipe (shown to the right end of the venturi divergence length in FIG. 1), a toner inlet is represented as a circular opening in the channel. The distance between the divergence location and the toner inlet, is referred to herein as the "venturi to toner inlet distance." And, the distance between the venturi throat and the end of the pipe is referred to herein as the "channel length." The distance between the venturi outlet and a substrate on which particles can be printed, generally is referred to herein as the "printing gap."

In accordance with the exemplary embodiments, various venturi configurations are provided that are particularly adapted for ballistic aerosol marking (BAM) applications, and particularly well suited for use with input gas pressures of from about 20 psi to about 120 psi, particularly from about 50 to about 100 psi, and more particularly, about 80 psi or less.

Although the preferred exemplary embodiment venturi configurations feature a venturi diameter or span of about 60 μm, as depicted in FIG. 1, the exemplary embodiment venturi configuration can in certain applications utilize diameters less than or greater than 60 μm, such as for example from about 40 μm to about 70 μm. This span is also referred to herein as the "channel width."

Generally, the exemplary embodiment venturi configurations utilize a venturi to toner inlet distance of from about 0 to about 100 μm, with preferred distances being about 0 μm.

The exemplary embodiment venturi configurations can also utilize particular channel lengths. Generally, such lengths can be within the range of from about 1 mm to about 5 mm (about 1,000 μm to about 5,000 μm). However, as described in greater detail herein, a channel length of about 2.75 mm (about 2,750 μm) is of particular significance.

The exemplary embodiment venturi configurations can also feature a venturi throat width of from about 10 μm to about 20 μm, with a venturi throat width of about 15 μm being preferred.

The exemplary embodiment venturi configurations can also feature a venturi divergence section length of from about 250 μm to about 500 μm. It is particularly preferred to utilize a divergence length of either about 250 μm or about 500 μm.

Particularly, the exemplary embodiment venturi configurations feature combinations of the previously noted dimensions, or more particularly, combinations of three or four of these noted dimensions.

Specifically, the exemplary embodiment venturi configurations utilize particular dimensional ratios. In one aspect, the venturi configurations feature a channel width to venturi throat width of from about 7:1 to about 2:1, and particularly from about 6:1 to about 3:1, respectively. Similarly, the exemplary embodiment venturi configurations can, in other aspects, feature a ratio of channel length to channel width of from about 125:1 to about 14:1, respectively, and particularly from about 100:1 to about 25:1, respectively. In certain embodiments, the venturi configuration can utilize dimensions falling within both ranges of ratios, e.g. having a channel width to venturi throat width of from about 7:1 to about 2:1, and a channel length to channel width of from about 125:1 to about 14:1.

The exemplary embodiment also relates to a ballistic aerosol marking system that includes a venturi as described herein and a particle source in communication with the venturi, generally at the inlet region of the venturi. The system utilizes a particular configuration and venturi based upon the average particle size of particles constituting the particle source. Generally, this relationship is with regard to the ratio of the channel width to the average size of particles. This ratio generally ranges from about 700:1 to about 2:1, respectively.

The exemplary embodiment venturis, systems, and BAM systems, can be utilized to eject solid particles or particulates as well as liquid particulates. Liquid particulates can for example, be in the form of liquid droplets or an aerosol. Thus, the term "particle" or "particulate" as used herein, includes both solid and liquid forms of particulates. Such particles, typically are within a size range of from about 0.1 microns to about 15 microns, and more particularly from about 0.1 microns to about 10 microns. However, the exemplary embodiment includes the use of larger or smaller particles.

In analyzing the exemplary embodiment venturi configurations, a series of trials were conducted as follows. In addition to toner imaging on a belt, printed images in the form of lines were quantified according to the width of the lines (line width) and the amount or degree of toner scatter on both sides of the line. The desired outcome is for a line width of approximately 110 μm which is typically a desired line width for complete area coverage at 300 dpi resolution. Generally, relatively narrow lines having a width of from about 75 μm to about 150 μm can be printed utilizing the BAM venturi configurations described herein. It is also desired that the edge of the lines be very sharp, thus containing minimal toner scatter. The line sharpness is measured as the MFLEN (mid-frequency line edge noise) top and bottom. When compared to a xerographic line, the desired MFLEN top and bottom is zero indicating a sharp edge without any toner scatter.

In one embodiment, placement of the toner aperture or inlet in a BAM channel is at the end of the divergence section of the venturi structure. It was determined that toner could not be continuously ejected out of the BAM channel if the toner aperture was defined further down the channel toward the venturi outlet and further away from the venturi throat. While maintaining a constant input gas pressure of 80 psi, four different values for the venturi divergence location to toner inlet distance (0, 100, 250 and 500 μm) were evaluated simultaneously by continuous printing of BAM lines using the parameters set forth in Table 1.

TABLE 1

| Parameters of Venturi | | | | |
|---|---|---|---|---|
| Channel ID Number | Venturi Throat Width (μm) | Venturi Diverg. Length (μm) | Venturi Channel Length (mm) | Venturi-Toner Inlet Distance (μm) |
| 1 | 10 | 100 | 275 | 0 |
| 2 | 10 | 100 | 275 | 100 |
| 3 | 10 | 100 | 275 | 250 |
| 4 | 10 | 100 | 275 | 500 |

Figure 2:
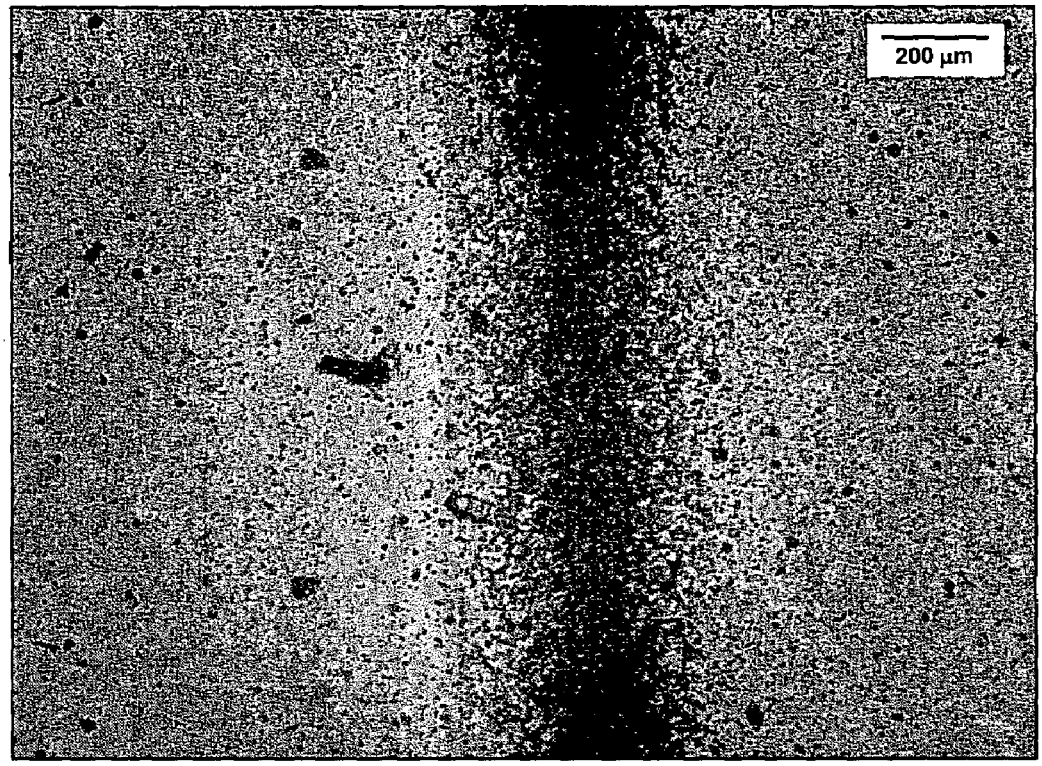
FIG. 2 is a detailed view of a line segment printed from an exemplary embodiment ballistic aerosol marking venturi pipe geometry utilizing a venturi to toner distance of 0 μm.
Figure 3:
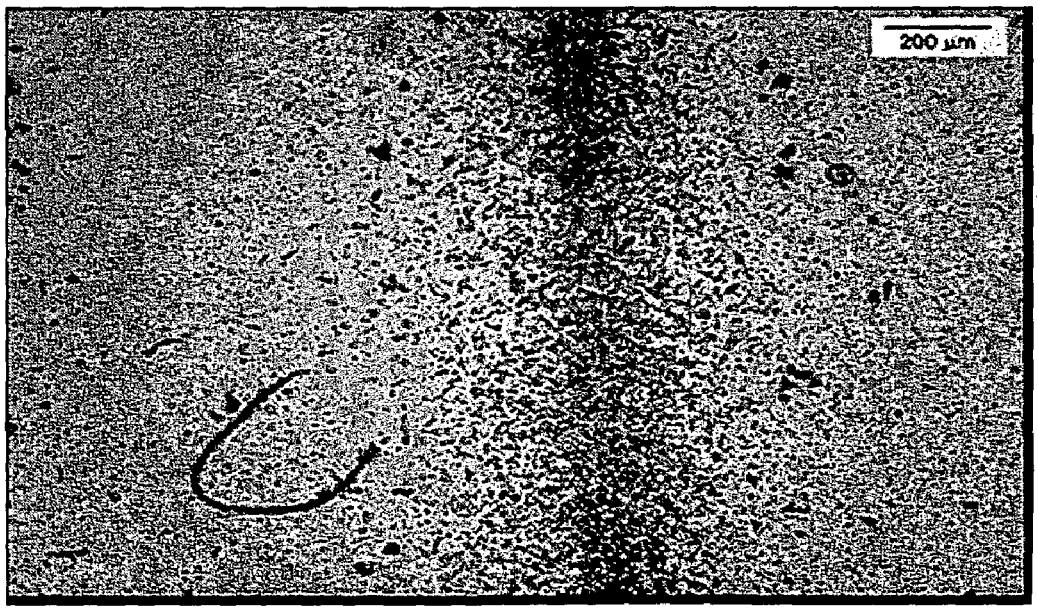
FIG. 3 is a detailed view of a line segment printed from an exemplary embodiment ballistic aerosol marking venturi pipe geometry utilizing a venturi to toner distance of 500 μm.

Using an input gas pressure of 80 psi, toner was ejected only from channel 1 and 2 (venturi-toner inlet distance of 0 and 100 μm) with channel 1 producing the densest line. Only by increasing the gas pressure into the venturi could toner be ejected from channels 3 and 4. Based on these results and other venturi configurations in which this parameter was varied, the preferred placement of the toner inlet was identified to be at the end of the venturi divergence section, i.e. the Venturi-Toner Inlet Distance of 0 μm. A comparison of printed lines from channel 1 (V-T inlet=0 μm) and 4 channel (V-T inlet=500 μm) is shown in FIGS. 2 and 3, respectively. This parameter was fixed for the remaining venturi pipe geometry analysis.

The other three pipe geometry parameters and two printing parameters were systematically evaluated using a mixed 2 and 3-level statistical design of experiments. The three parameters of the BAM venturi structure were venturi throat width (10 and 15 μm), channel length (1.0 and 2.75 mm) and venturi divergence length (250 and 500 μm). And the two printing parameters were input gas pressure (20, 50 and 80 psi) and printing gap distance (0.5, 1.0 and 2.0 mm). The experimental design generated by Statistica consisted of 36 experiments, which is one-full factorial design.

Figure 4:
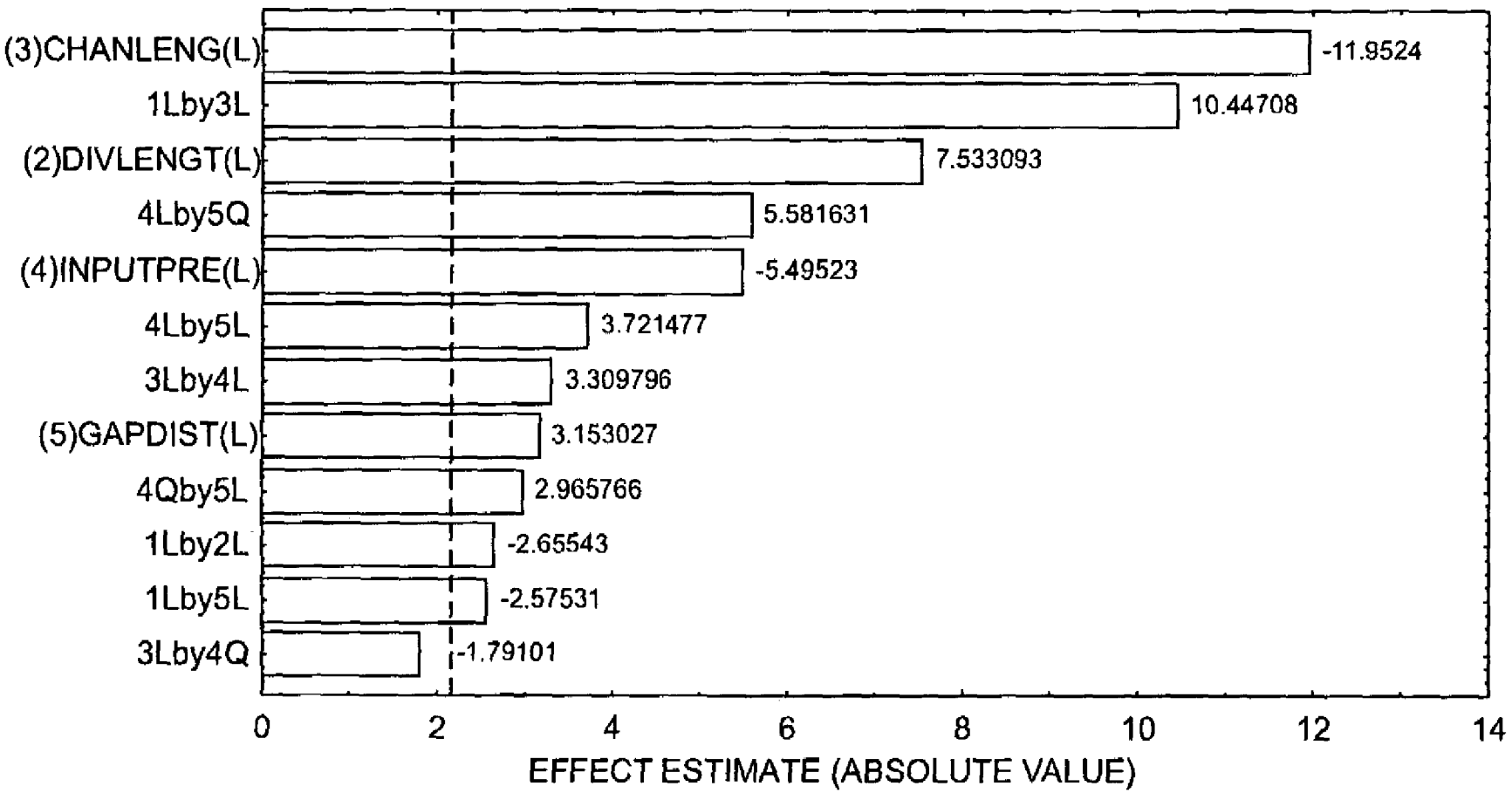
FIG. 4 is a Pareto chart illustrating the ranking of certain variables as to their effect upon printed line width using the exemplary embodiment ballistic aerosol marking venturi pipe geometry.
Figure 5:
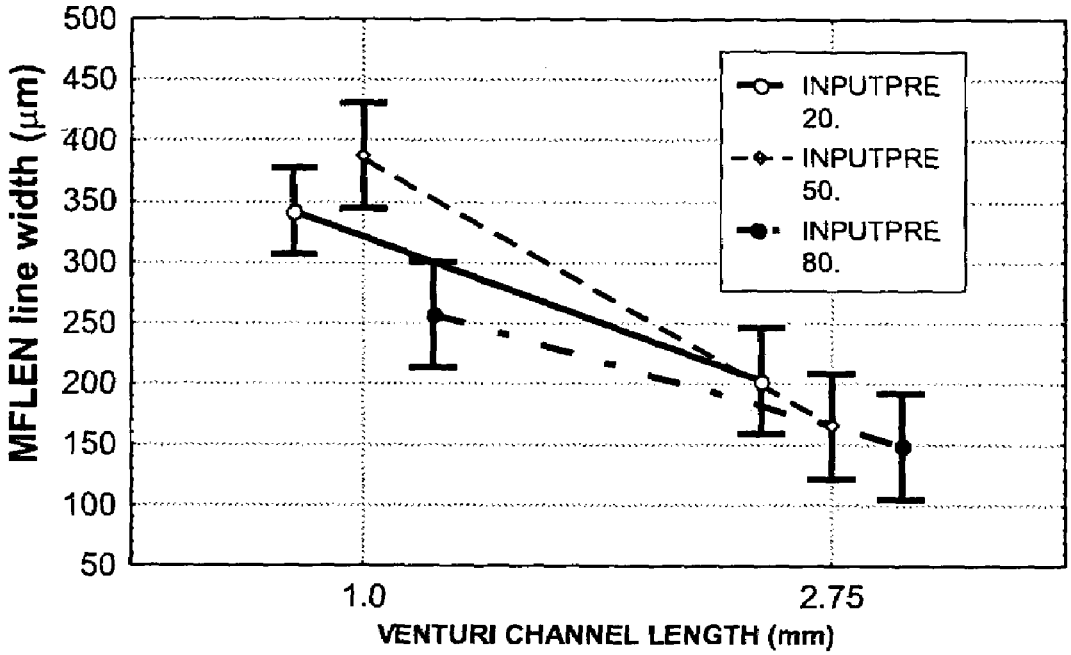
FIG. 5 is a graph illustrating the effect of venturi channel length upon printed line width for one set of parameters.
Figure 6:
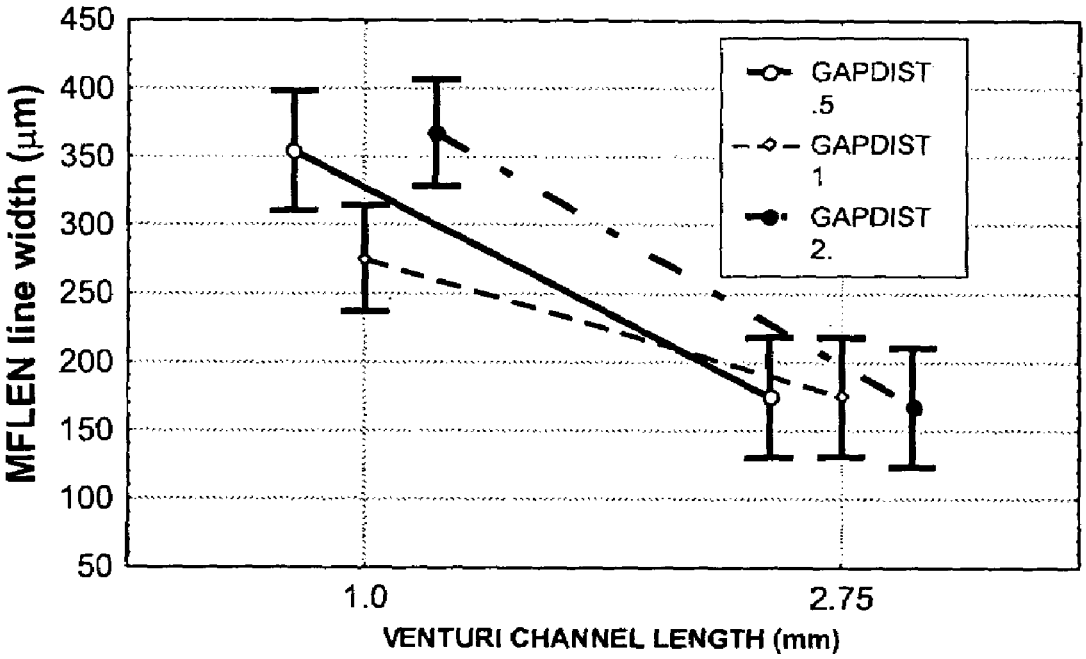
FIG. 6 is a graph illustrating the effect of venturi channel length upon printed line width for another set of parameters.

After completion of the experiments using BAM print heads utilizing a fixed venturi to toner inlet distance of zero, the data line width measured by microscopy and MFLEN (mid-frequency line edge noise) was analyzed using Statistica and the best model to fit the MFLEN line width response with the least amount of terms was produced. The Pareto chart set forth in FIG. 4 provides a ranking of the terms in the line width model in a bar graph format with the most important terms at the top of the chart and the least important terms at the bottom. [0032] The most important parameter identified from the statistical analysis which affects the width of the printed lines without controlled toner gating, was the venturi channel length. As shown in FIGS. 5 and 6, the longer channel length of 2.75 mm produced narrower printed BAM lines regardless of the input gas pressure (20, 50 and 80 psi) and also the printing gap distance (0.5,1.0 and 2.0 mm) between the substrate and the print head. This is depicted in FIG. 1 as "gap." Even though only 2 settings were used to evaluate the channel length, the statistical analysis shows a trend that longer channel lengths will decrease the line width, therefore, the exemplary embodiment does not limit the channel length to just 2.75 mm but includes the extension of the channel up to for example 5 mm or longer provided the exiting toner particle stream is well collimated.

Specifically, with further reference to FIGS. 5 and 6, those figures summarize the MFLEN line width as a function of venturi channel length at specific input pressures and printing gap distances. The statistical analysis of the data indicates that a longer channel length of 2.75 mm enables narrower printed BAM lines.

Figure 7:
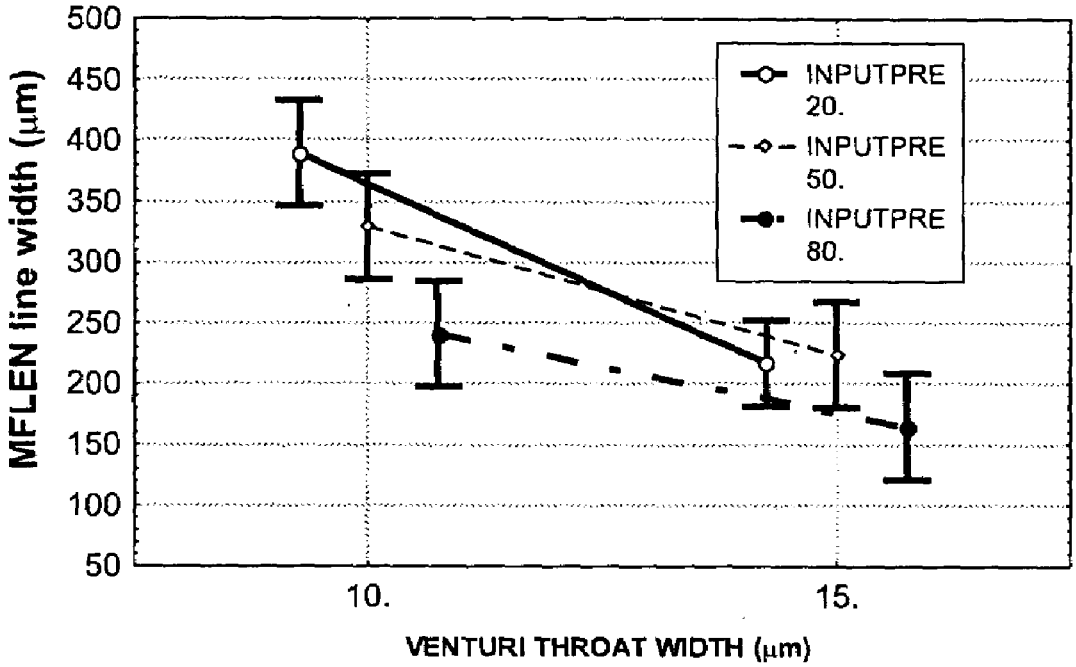
FIG. 7 is a graph illustrating the effect of venturi throat width upon printed line width for one set of parameters.
Figure 8:
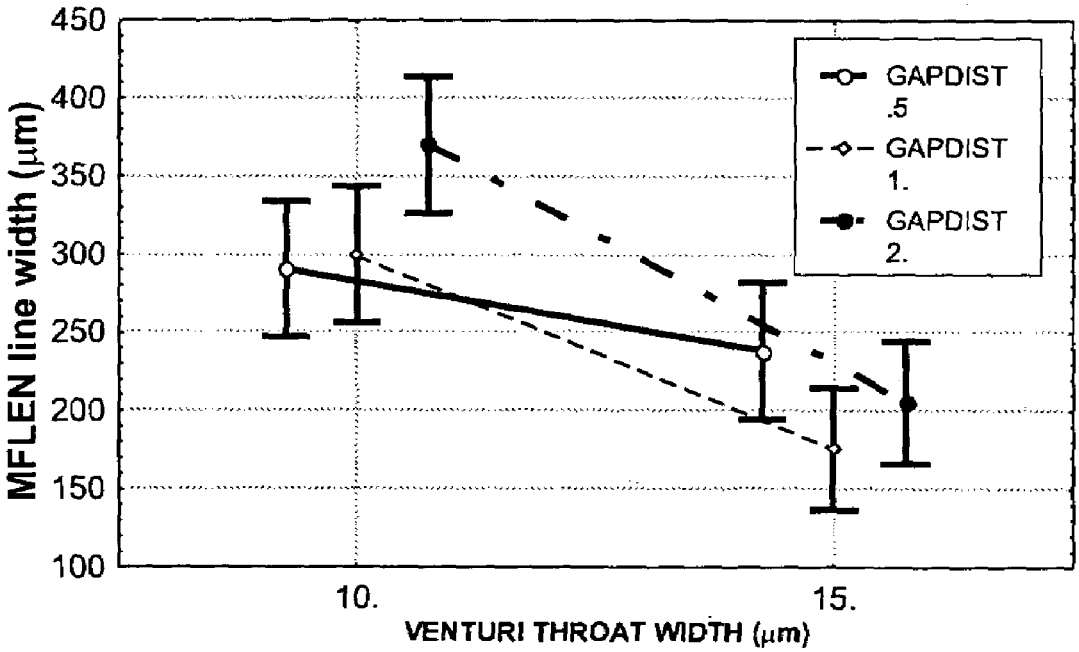
FIG. 8 is a graph illustrating the effect of venturi throat width upon printed line width for another set of parameters.

The next most important BAM venturi pipe parameter that affects the width of the continuously printed lines without controlled toner gating is the width of the venturi throat. Analysis of the MFLEN line width using Statistica software indicates that narrower lines are obtained when the venturi throat width is wider at 15 μm as compared to 10 μm for all input gas pressures used (20, 50 and 80 psi) and for all printing gap distances (0.5,1.0 and 2.0 mm). These aspects are illustrated in FIGS. 7 and 8. Specifically, these figures summarize the MFLEN line width as a function of venturi throat width at specific input pressures and printing gap distances. The statistical analysis of the data indicates that wider throat widths of 15 microns as compared to 10 microns aids in the continuous printing of narrower printed BAM lines when controlled toner gating is not integrated into the system.

Figure 9:
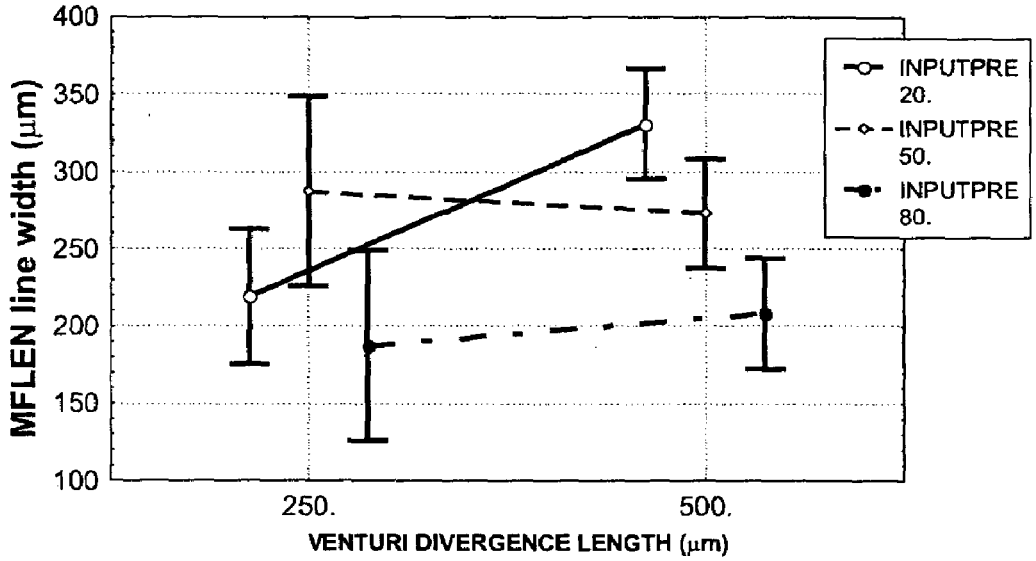
FIG. 9 is a graph illustrating the effect of venturi divergence length upon printed line width for one set of parameters.
Figure 10:
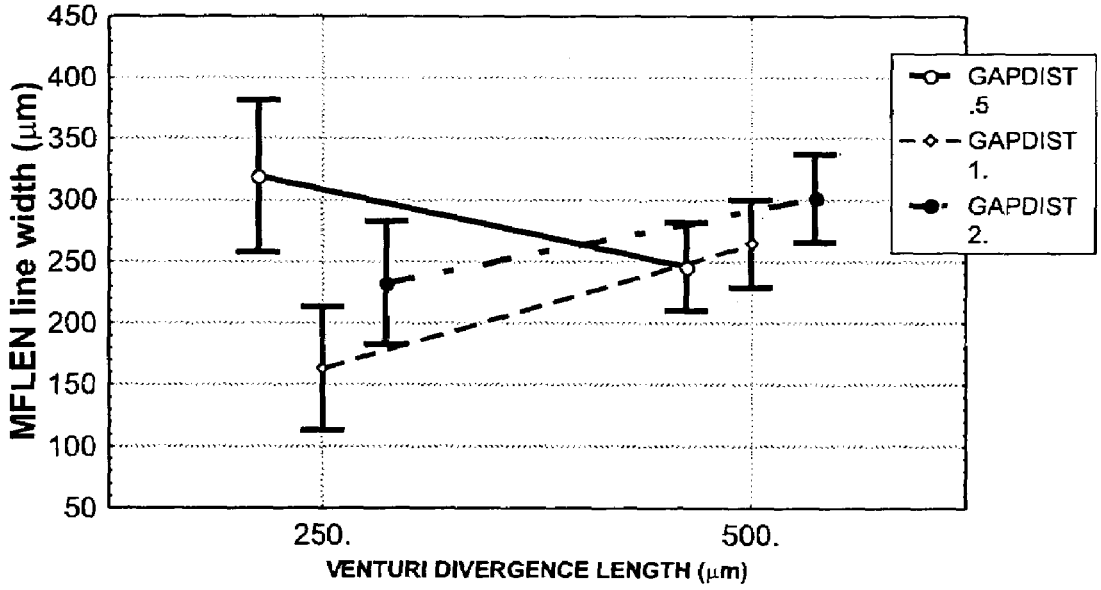
FIG. 10 is a graph illustrating the effect of venturi divergence length upon printed line width for another set of parameters.

Analysis of the third BAM venturi pipe geometry parameter, the length of the venturi divergence section, is not as critical a parameter in affecting the line width as measured by MFLEN, as evident in FIGS. 9 and 10. When the input gas pressure is 20 and 80 psi, the line width increases when the divergence length is changed from 250 μm to 500 μm. But, the increase is well within the experimental noise of the measurement and at 50 psi the line width, decreases slightly but again within the experimental error and noise of the measurement. Similarly, the effect of changing the divergence length on the MFLEN line width when the printing gap distance is varied also shows opposing trends in the data. Based on this analysis it was believed that both the 250 and 500 μm venturi divergence lengths can, in certain embodiments, provide significant utility.

The summary of the analysis with respect to the divergence length is shown in FIGS. 9 and 10. These figures summarize the MFLEN line width as a function of changing the venturi divergence length at specific input pressures and printing gap distances. The statistical analysis of the data indicates that there is no clear preference between divergence lengths of either 250 or 500 microns.

Figure 11:
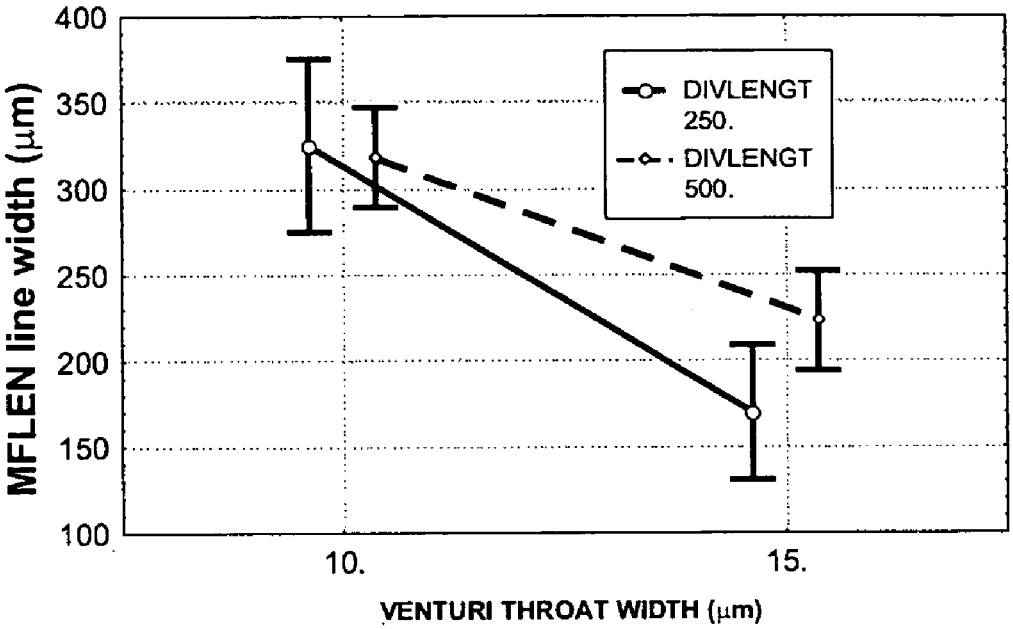
FIG. 11 is a graph illustrating the effect of venturi throat width upon printed line width for a set of parameters.
Figure 12:
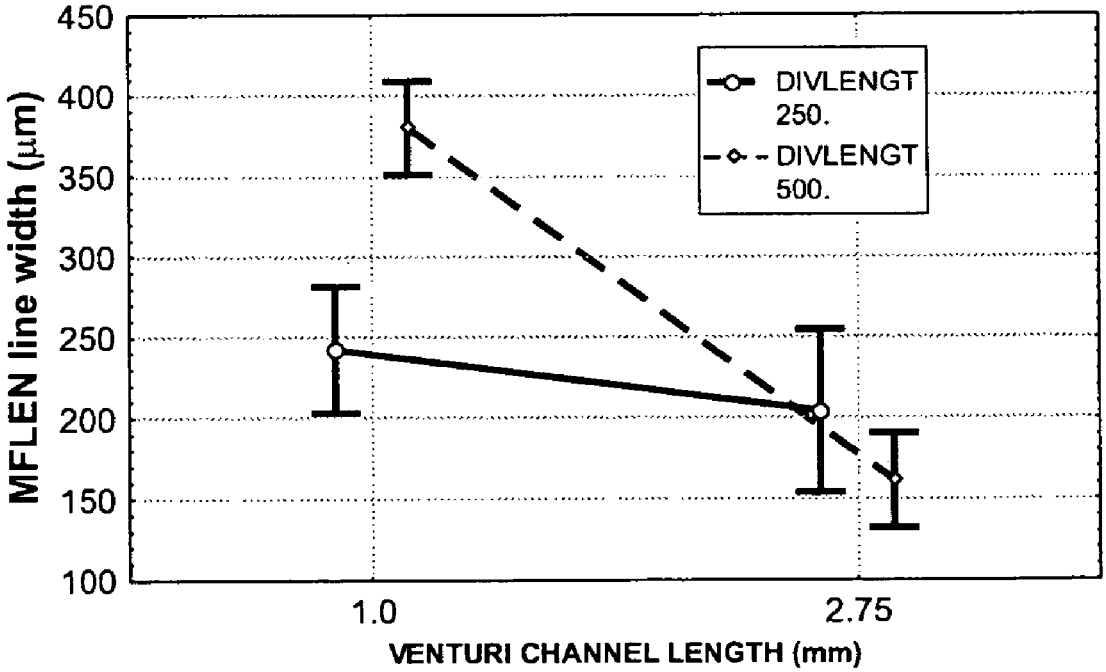
FIG. 12 is a graph illustrating venturi channel length upon printed line width.

Since both the 250 and 500 μm venturi divergence lengths were identified from the statistical analysis as not showing a clear preference, the MFLEN line width data was analyzed separately at each divergence length (250 and 500 μm), to determine what effect the venturi throat width and channel length had. This is shown in FIGS. 11 and 12. In FIG. 11, the line width is significantly narrower when the venturi throat width is 15 μm as compared to 10 μm for both 250 and 500 μm divergence lengths. In FIG. 12, the MFLEN line width as a function of the channel length for both 250 and 500 mm divergence lengths illustrates a decrease for these continuously printed lines when the channel length is longer in both cases. As a consequence, two geometries were identified as particularly significant embodiments, and designated as BAMGeo1 comprising a throat width =15 μm, a channel length =2.75 mm and a divergence length =250 μm; and BAMGeo2 comprising a throat width=15 μm, a channel length =2.75 mm and a divergence length=500 μm.

Specifically, FIGS. 11 and 12 summarize the MFLEN line width as a function of venturi throat width (FIG. 11) at both 250 and 500 μm venturi divergence lengths. This is compared to the MFLEN line width as a function of venturi channel length (FIG. 12) also at both 250 and 500 μm venturi divergence lengths.

When continuously printed BAM lines were produced using one of the identified pipe geometries BAMGeo2 (throat width=15 μm, channel length=2.75 mm and divergence length=500 μm) and subsequently quantified by measuring the line width using the MFLEN technique, it was found that the MFLEN line width was 117.4 +/−14.2 μm with the following MFLEN top (0.2 +/−0.4) and MFLEN bottom (0.5 +/−1.0) at a printing gap distance of 0.5 mm and input gas pressure of 80 psi. When the printing gap distance was increased to 1.0 mm at an input gas pressure of 80 psi the MFLEN line width was 110.5 +/−12.0 with the MFLEN top and bottom as 0.2 +/−0.4 and 0.0 +/−0.0 respectively.

The exemplary embodiment provides various ballistic aerosol marking venturis and related venturi configurations adapted for continuous ejection of a collimated particle stream that is uniquely suited for direct printing applications. The exemplary embodiment systems and venturi configurations are particularly well adapted for ejecting particulates that are solid or liquid. That is, the exemplary embodiment is suited for the ejection of liquids in particulate or droplet form, as well as solid particles. The exemplary embodiment also provides ballistic aerosol marking venturis that are free from a particulate gating component or assembly that is otherwise generally required as known in the art. Such gating component serves to gate particulates onto a substrate such as an intermediate transfer belt substrate. The exemplary embodiment venturis are particularly well adapted for ejecting particles having a size of from about 0.1 microns to about 5 microns and larger particles such as up to about 10 microns, or 15 microns. However, the exemplary embodiment venturis can also be readily tailored to eject significantly larger particles such as powders.

It will be appreciated that variations of the above-disclosed and other features and functions, or alternatives thereof, may be desirably combined into many other different systems or applications. Also that variations presently unforeseen or unanticipated alternatives, modifications, variations or improvements therein may be subsequently made by those skilled in the art which are also intended to be encompassed by the following claims.

The invention claimed is:

1. A ballistic aerosol marking venturi, the venturi defining a channel width, an inlet, an outlet opposite from the inlet, a venturi throat between the inlet and the outlet, a divergence location between the venturi throat and the outlet, and a particle inlet location between the divergence location and the outlet, wherein the ratio of the channel width to the width of the venturi throat ranges from about 7:1 to about 2:1, respectively.

2. The venturi of claim 1 wherein the ratio ranges from about 6:1 to about 3:1, respectively.

3. The venturi of claim 1 wherein the distance between the venturi throat and the outlet is the channel length and the ratio of the channel length to the channel width ranges from about 125:1 to about 14:1, respectively.

4. The venturi of claim 1 wherein the venturi throat width is from about 10 μm to about 20 μm.

5. The venturi of claim 1 wherein the distance between the venturi throat and the divergence location is from about 250 μm to about 500 μm.

6. The venturi of claim 1 wherein the venturi is adapted to continuously print narrow lines utilizing an input gas pressure less than about 80 psi.

7. The venturi of claim 1 wherein the venturi is free from a particulate gating component or assembly that serves to gate particulates onto a substrate.

8. The venturi of claim 7 wherein the substrate is an intermediate transfer belt substrate.

9. The venturi of claim 1 wherein the venturi is adapted to eject particles having a size of from about 0.1 microns to about 10 microns.

10. The venturi of claim 1 wherein the venturi is utilized to eject solid particulates.

11. The venturi of claim 1 wherein the venturi is utilized to eject liquid particulates.

12. A ballistic aerosol marking venturi, the venturi defining a channel width, an inlet, an outlet opposite from the inlet, a venturi throat between the inlet and the outlet, a divergence location between the venturi throat and the outlet, a channel length extending between the venturi throat and the outlet, and a particle inlet location between the divergence location and the outlet, wherein the ratio of the channel length to the channel width ranges from about 125:1 to about 14:1, respectively.

13. The venturi of claim 12 wherein the ratio ranges from about 100:1 to about 25:1, respectively.

14. The venturi of claim 12 wherein the ratio of the channel width to the width of the venturi throat ranges from about 7:1 to about 2:1, respectively.

15. The venturi of claim 12 wherein the venturi throat width is from about 10 μm to about 20 μm.

16. The venturi of claim 12 wherein the distance between the venturi throat and the divergence location is from about 250 μm to about 500 μm.

17. The venturi of claim 12 wherein the venturi is adapted to continuously print narrow lines utilizing an input gas pressure less than about 80 psi.

18. The venturi of claim 12 wherein the venturi is free from a particulate gating component or assembly that serves to gate particulates onto a substrate.

19. The venturi of claim 18 wherein the substrate is an intermediate transfer belt substrate.

20. The venturi of claim 12 wherein the venturi is adapted to eject particles having a size of from about 0.1 microns to about 10 microns.

21. The venturi of claim 12 wherein the venturi is utilized to eject solid particulates.

22. The venturi of claim 1 wherein the venturi is utilized to eject liquid particulates.

23. A ballistic aerosol marking system including a venturi and a particle source, the venturi defining a channel width, an inlet, an outlet opposite from the inlet, a venturi throat between the inlet and the outlet, a divergence location between the venturi throat and the outlet, a channel length extending between the venturi throat and the outlet, and a particle inlet location between the divergence location and the outlet, the particle source being in communication with the particle inlet, wherein the ratio of the channel width to the average size of particles of the particle source is in the range of from about 700:1 to about 2:1, respectively.

24. The system of claim 23 wherein the ratio of the channel width to the width of the venturi throat ranges from about 7:1 to about 2:1, respectively.

25. The system of claim 24 wherein the ratio of the channel width to the width of the venturi throat ranges from about 6:1 to about 3:1, respectively.

26. The system of claim 23 wherein the ratio of the channel length to the channel width ranges from about 125:1 to about 14:1, respectively.

27. The system of claim 23 wherein the venturi throat width is from about 10 μm to about 20 μm.

* * * * *